US006552660B1

(12) United States Patent
Lisowski

(10) Patent No.: US 6,552,660 B1
(45) Date of Patent: Apr. 22, 2003

(54) FLEXIBLE SMOKE GENERATOR

(75) Inventor: Rich Lisowski, St. Peter's, PA (US)

(73) Assignee: 3SI Security Systems, Inc., New York, NY (US)

( * ) Notice: Subject to any disclaimer, the term of this patent is extended or adjusted under 35 U.S.C. 154(b) by 105 days.

(21) Appl. No.: 09/605,071

(22) Filed: Jun. 28, 2000

(51) Int. Cl.[7] ..... G08B 13/14
(52) U.S. Cl. ..... 340/568.7; 340/693; 340/571
(58) Field of Search ..... 340/568.7, 568.1, 340/571, 693, 559, 572.1, 691; 116/2, 104, 211, 214, 217, 218, 219; 42/1.08, 1.13

(56) References Cited

U.S. PATENT DOCUMENTS

| | | | | |
|---|---|---|---|---|
| 3,052,577 | A | 9/1962 | Butler et al. | 149/19 |
| 4,025,369 | A | 5/1977 | Price et al. | 149/19.6 |
| 4,101,352 | A | 7/1978 | Poulin et al. | 149/19.2 |
| 4,225,368 | A | 9/1980 | Couture et al. | 149/19.9 |
| 4,474,715 | A | 10/1984 | Weber et al. | 264/3 |
| H227 | H | 3/1987 | Tracy et al. | 149/84 |
| 5,059,949 | A | 10/1991 | Caparoni et al. | 340/571 |
| 5,196,828 | A | 3/1993 | Keniston | 340/571 |
| 5,485,143 | A | 1/1996 | Keniston | 340/568 |
| 5,734,325 | A | 3/1998 | Johnson et al. | 340/568 |
| 5,918,554 | A | 7/1999 | Rassamni | 109/29 |

FOREIGN PATENT DOCUMENTS

| | | |
|---|---|---|
| CA | 1 056 688 | 6/1979 |
| DE | 1 156 690 | 10/1963 |
| EP | 0 046 230 | 2/1982 |
| EP | 0 632 418 A1 | 1/1995 |
| FR | 2 324 595 | 4/1977 |
| GB | 1 520 601 | 8/1978 |

*Primary Examiner*—Daryl Pope
(74) *Attorney, Agent, or Firm*—RatnerPrestia

(57) ABSTRACT

A pyrotechnic smoke generator which is flexible and may be molded or extruded into a thin layer is provided by embedding smoke composition particles in an elastomer, preferably silicone. The smoke composition particles have a preferred particle size range which will pass through a number 18 sieve and not through a number 40 sieve. The smoke generator may be utilized with flexible circuitry in a currency alarm pack to provide a money pack with an alarm which provides the flexibility and feel of a money pack without an alarm pack. The smoke composition particles when used in a money pack would contain a red dye and may contain tear gas. The smoke generator may be provided with a film covering, such as polyurethane, or embedded reinforcing fibers for additional strength. A film coating may also provide additional sealing capability for sealing the smoke composition particles and tear gas within the elastomer.

28 Claims, 2 Drawing Sheets

FIG.1
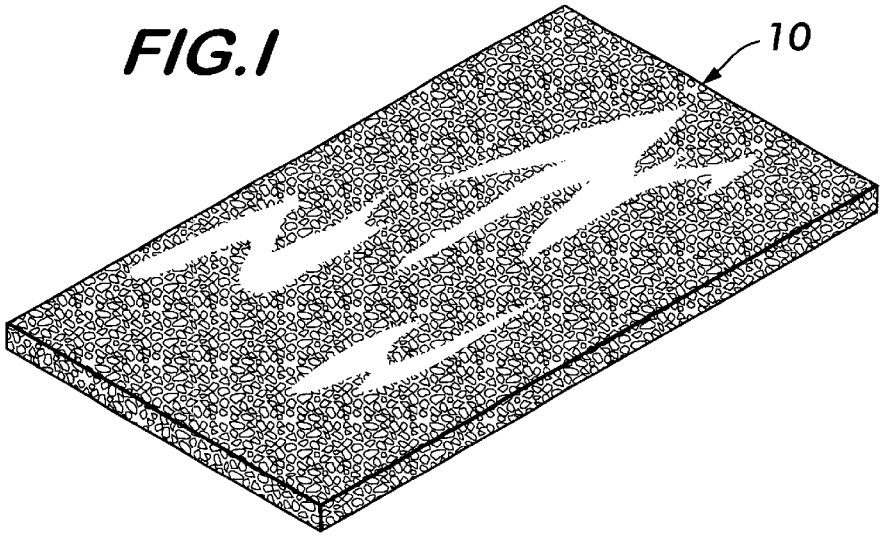
FIG.1A
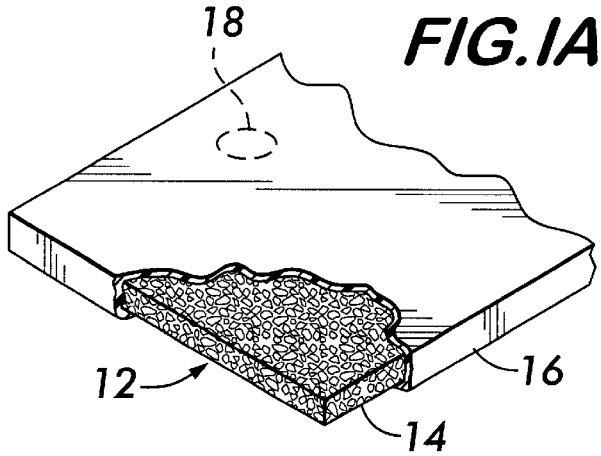
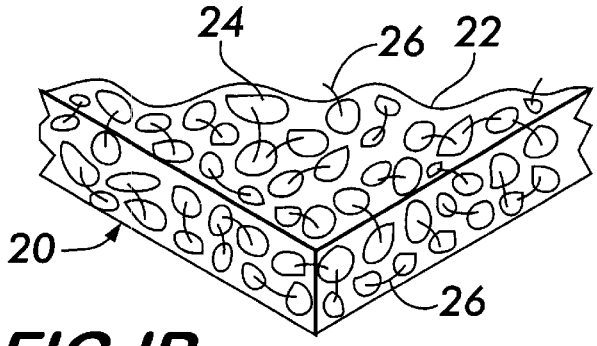
FIG.1B

FIG.2
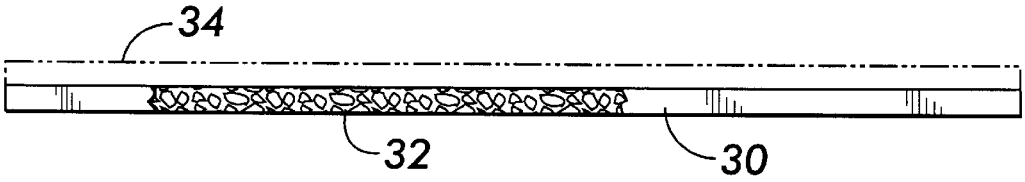
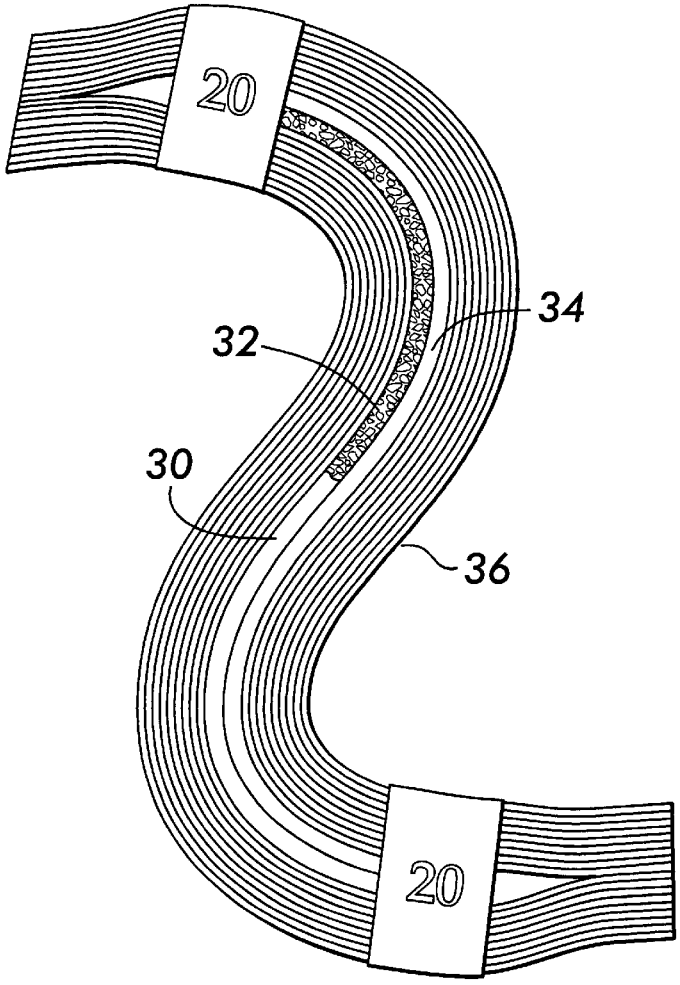
FIG.3

FLEXIBLE SMOKE GENERATOR

FIELD OF THE INVENTION

The present invention relates to the field of smoke generators. More particularly, the present invention relates to a pyrotechnic smoke generator which is flexible.

BACKGROUND OF THE INVENTION

In one field of application of the present invention, although the present invention may be applied in other fields, there has been a need for a smoke generator which contains a dye which may be inserted into a pack of currency bills, where it is not readily obvious that the pack of bills contains the smoke generator. One major application of this technology today is in the field of foiling bank robberies and robberies of other financial institutions and money transporters. In the past, the center of the bill pack has been cut out and a security dye pack including a smoke generator either in the form of a plurality of rigid pellets or a plastic bag containing smoke composition were mounted in the bill pack. For example, see U.S. Pat. No. 5,059,949—Caparoni et al. and U.S. Pat. Nos. 5,196,828 and 5,485,143—Keniston.

It is very desirable in the field of currency alarm packs to provide a smoke generator along with circuitry wherein a currency alarm pack with a smoke generator and associated circuitry closely resembles a currency pack without a currency alarm pack, particularly in its feel thereby reducing the likelihood that a thief will be able to distinguish it from a real or unalarmed currency pack. In this regard, it is important that the smoke generator have lateral and torsional flexibility approaching that of a stack of currency bills of the same thickness.

SUMMARY OF THE INVENTION

One advantage of the smoke generator of the present invention is that it is very flexible having both lateral flexibility and torsional flexibility.

Another advantage of the present invention is that it may be made relatively thin and of any dimension.

Another advantage of the present invention is that it has a certain degree of elasticity due to the elastomer or silicone which enhances its flexibility.

Another advantage of the present invention is that the smoke composition, including any dye therein, is embedded, and therefore the dye and other active chemical material is not exposed thereby avoiding the possibility of getting red dye or other active chemicals dispersed about the work area.

Another advantage of the present invention is that it may be manufactured separate from the ignition source. Further, the smoke generator may be shipped separate from the electric ignition source, thereby making shipment safer and subject to less regulation.

Another advantage of the present invention is that the smoke generator of the present invention may be formed into any shape. Particularly, for use in a security currency pack, the smoke generator may be formed into a thin layer.

Another advantage of the present invention is that the thin layer smoke generator may be used in a money pack without cutting out the center of the money pack.

Briefly and basically, in accordance with the present invention, an apparatus for generating smoke is provided wherein an elastomer layer, such as a silicone layer, is formed with smoke composition particles of a predetermined size disbursed throughout the elastomer or silicone layer whereby the elastomer or silicone layer containing smoke composition particles is flexible.

In a presently preferred embodiment, the smoke composition particles have a size which will pass through a number 18 sieve, but not through a number 40 sieve.

If the flexible smoke generator is utilized as a security device in a money pack, it would be provided with a flexible circuit juxtaposed thereto as well as batteries and an antenna for receiving an activation signal.

In a presently preferred embodiment, the smoke composition particles contained in the smoke generator, when utilized for security in a currency pack, would contain a red dye. In other applications, no dye or any suitable color of dye may be utilized. In an alternative embodiment, particularly in the money pack alarm field in addition to the red dye, the smoke generator may be provided with a tear gas composition.

In an alternative embodiment, the silicone layer containing the smoke composition particles may be provided with a film on its outer surface to enhance the strength, flexibility and slidability of the silicone layer with respect to the currency bills. The outer layer of film may also provide an additional sealant for sealing the red dye and tear gas components within the silicone layer.

In another alternative embodiment, the silicone layer may be provided with reinforcing fibers to increase the strength of the silicone layer. These fibers may be any suitable fibers such as fiberglass or carbon.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of a smoke generator in accordance with the present invention.

FIG. 1A is a broken away portion of an alternate embodiment of a smoke generator in accordance with the present invention which utilizes a covering film.

FIG. 1B is a broken away view of an alternate embodiment of a smoke generator in accordance with the present invention which utilizes reinforcing fibers.

FIG. 2 is a broken away side elevation view of a smoke generator in accordance with the present invention mounted juxtaposed ignition control components of a security money dye pack shown in dotted outline form.

FIG. 3 is a side elevation view, partially broken away, of a currency pack containing a smoke generator and ignition control circuitry components, wherein the smoke generator is partially broken away.

DETAILED DESCRIPTION OF THE PREFERRED EMBODIMENTS

Referring now to the drawings, where like numerals indicate like elements, there is shown in FIG. 1 a smoke generator 10 which is comprised of an elastomer, preferably silicone, forming a layer with smoke composition particles dispersed throughout. The elastomer may be various types of elastomers which provide the desired degree of flexibility and a certain degree of elasticity to provide full lateral and torsional flexibility. The elastomer should be chosen to be stable at temperatures above those at which the smoke composition burns in order to avoid the absorption of heat from sublimation process or the smoke generating reaction. Silicone materials are presently preferred and various suitable silicone materials may be utilized. In a presently preferred embodiment, RTV 615 silicone which is commercially available from General Electric Company is preferred. This silicone has a useful temperature range from −60° C. to 204° C. RTV 615 silicone is a two-part silicone, one part being resin and the other a catalyst, to produce an odorless curing silicone which cures in the absence of moisture.

The smoke composition particles may be produced from various known active chemicals used for this purpose in the industry. Further, where the term "active chemicals" is used herein, it is understood that it includes any such active chemicals that may be utilized in applications of the type herein discussed, including those for generating smoke from a sublimation process, dyes of various colors and/or tear gas generating compositions. However, a presently preferred smoke composition containing red dye for use in currency security packs is comprised of approximately by weight 49.25% red dye, 28.25% potassium chlorate, 21.75% confectioner's sugar and 0.75% of an inert binder, which is preferably magnesium stearate. The smoke composition materials may be dry blended or mixed and pressed into a form such as a pellet, which is then suitable for grinding or granulation. In a preferred embodiment, the ground smoke composition particles which result from the grinding or granulation are then selected by size such that they will pass through a number 18 sieve, but will not pass through a number 40 sieve. It is understood that particle sizes outside this range may work within the scope of the present invention so long as they produce smoke via a solid state chemical reaction not impeded by the elastomer, such as a sublimation process when ignited. The presently preferred particle size has been found to produce a desirable rate of smoke output. In a presently preferred embodiment, the smoke output is selected to continue at a rate of 5 to 10 seconds per square inch of 0.1 inch thick smoke generator. The rate and duration of smoke output may be varied by varying the particle size and composition of the smoke generating particles. Confectioner's sugar by definition contains cornstarch, and the confectioner's sugar used herein should contain cornstarch in addition to the finely pulverized sugar.

In manufacturing the smoke generator of the present invention, the two parts of the RTV 615 silicone are mixed to produce a liquid having a viscosity which will allow for mixing of the smoke particles with the elastomer and molding or extrusion. In a presently preferred embodiment, the viscosity would be about 4,000 centipoise. However, it is understood that the viscosity of the elastomer liquid prior to curing may vary greatly from the presently preferred value, which is prepared by manual mixing of the smoke particles into the elastomer liquid. Even with manual mixing, the viscosity may vary significantly from this value, and with machine mixing, and particularly where extrusion may be utilized, the viscosity values may be significantly greater than the presently preferred viscosity value.

The smoke composition particles, as described above, having a size passing through a number 18 sieve and not through a number 40 sieve, are mixed in with the silicone. The ratio by weight of smoke composition particles to silicone is preferably in the range from about 2.4 to 4.0 grams of smoke composition particles for each gram of silicone. The viscous silicone containing the particles may then be molded or extruded to any desirable shape. For use in connection with currency security packs, the silicone containing smoke composition particles is preferably molded or extruded into a thin layer of about 0.1 inch thick or less. When used in connection with currency security dye packs, the width and height of the molded or extruded silicone would be equal to or less than the length and width of the currency in connection with which it is intended to be used. In a presently preferred embodiment, the length of the smoke generator would be about 3.9 inches and the width about 1.9 inches which is smaller than U.S. currency which is approximately 6 3/16 inches long and 2 5/8 inches wide. Positioning tabs may be used on the associated ignition control circuitry similar to that shown and described in U.S. Pat. No. 5,059,949—Caparoni et al. It is understood throughout the specification that although the invention is being described in connection with a preferred embodiment of RTV 615 silicone, that various other elastomers may be utilized in practicing the present invention including the various alternate embodiments.

Referring now to FIG. 1A, there is shown an alternate embodiment of the present invention wherein a smoke generator 12 is constructed as having a core section 14 similar to that as described with respect to FIG. 1, with a film or coating 16 covering the outer surface. The film, coating or covering 16 may be polyurethane such as that commercially available from the 3M Company under the trademark TEGADERM or other suitable material which would provide additional strength for smoke generator 12 as well as additional sealing capabilities. The additional strength enables flexing to a greater degree without risk of the elastomer or silicone layer breaking. The TEGADERM film provides strength and memory enhancing the ability of the elastomer layer to return to its original shape. Furthermore, the film or coating 16 would have a high lubricity or low friction, particularly when used as a smoke generator in a currency security pack so that the smoke generator would slide easily against the adjacent currency bills when the currency pack is flexed by a robber. Also shown in FIG. 1A is a space 18 for receiving a pellet or pill of tear gas. In one embodiment for providing tear gas capabilities, a pill may be placed in a cavity or space 18 in the smoke generator core 14. Alternatively, the tear gas composition may be mixed in with the elastomer or silicone as a part of the smoke composition material. In the embodiment of FIG. 1A, the film or coating 16 could be used to provide additional sealing capabilities to prevent any leakage of tear gas from the material.

Referring to FIG. 1B, there is shown an alternate embodiment wherein smoke generator 20 is comprised of an elastomer 22 with smoke composition particles 24 distributed therein along with reinforcing fibers 26. The reinforcing fibers may be any suitable type of reinforcing fibers such as glass fibers or carbon fibers. Glass fibers, such as those commercially available under the FIBERGLASS trademark of Owens-Corning Corp. are presently preferred.

Referring now to FIG. 2, there is shown in side elevation a smoke generator 30, partially broken away to show the particles 32 therein. In dotted outline form, flexible ignition control circuitry 34 is provided. The flexible ignition control circuitry may be circuitry formed on a flexible substrate such as mylar with appropriate components thereon. One of these components would be an electrically activated ignition source having sufficient heat output to ignite the smoke generator. The electric ignition source would be connected to or in contact with the smoke generator 30 conducting the particles 32 to initiate the sublimation process in response to an electrical signal. The electric ignition source may preferably be held in contact with the smoke generator by a high temperature tape. The components on the flexible ignition control circuitry may include an antenna for receiving an activating signal as well as a magnetic reed switch as commonly used in these applications. The manner in which a magnetic reed switch or an antenna may be utilized in this field is described in the Background section in U.S. Pat. No. 5,485,143.

Referring now to FIG. 3, there is shown a smoke generator 30 and associated flexible ignition control components 34 positioned in a currency pack 36 which has been flexed in a "S" shape. The flexibility of the smoke generator 30 allows flexing of the currency pack and the currency pack presents a feel to a robber similar to that of a currency pack without a security alarm pack contained therein.

The present invention may be embodied in other specific forms without departing from the spirit or essential attributes thereof and, accordingly, reference should be made to the appended claims, rather than to the foregoing specification as indicating the scope of the invention.

I claim:

1. An apparatus for generating smoke, the apparatus comprising:

an elastomer formed in a layer; and smoke composition particles disbursed throughout said elastomer layer and adapted to generate smoke when ignited;

wherein the elastomer layer containing the smoke composition particles is flexible.

2. The apparatus of claim 1, wherein said elastomer comprises silicone.

3. The apparatus of claim 1, wherein said smoke composition particles have a size small enough to pass through a number 18 sieve, but too large to pass through a number 40 sieve.

4. The apparatus of claim 1, wherein the ratio by weight of smoke composition particles to the elastomer is in a range of about 2.4 to 4.0 grams of smoke composition particles to each gram of elastomer.

5. The apparatus of claim 2, wherein said elastomer layer comprises a resin and a catalyst that are mixed to produce a silicone which cures in the absence of moisture.

6. The apparatus of claim 1, wherein said elastomer prior to curing has a viscosity that enables mixing the smoke particles into the elastomer and further enables molding or extrusion.

7. The apparatus of claim 6, wherein said elastomer layer prior to curing comprises silicone having a viscosity in a range of about 4,000 centipoise.

8. The apparatus of claim 1, wherein said elastomer layer comprises a film on its outer surface.

9. The apparatus of claim 8, wherein said film comprises polyurethane.

10. The apparatus of claim 1, wherein said smoke composition particles comprise a dye.

11. The apparatus of claim 10, wherein said dye comprises a red dye.

12. The apparatus of claim 1, wherein said smoke composition particles comprise a plurality of components comprising by weight approximately:

49.25% red dye;

28.25% potassium chlorate;

21.75% confectioners' sugar; and 0.75% inert binder.

13. The apparatus of claim 12, wherein said inert binder comprises magnesium stearate.

14. The apparatus of claim 12, wherein said components have been dry blended, pressed into a shape and then granulated to a smaller particle size.

15. The apparatus of claim 1 futher comprising:

an electric ignition source in contact with said elastomer layer; and a flexible electrical circuit adjacent said elastomer layer for activating said electric ignition source.

16. The apparatus of claim 15, wherein said flexible electrical circuit includes an antenna.

17. The apparatus of claim 1, wherein said smoke composition particles comprise a tear gas composition.

18. The apparatus of claim 1, wherein said elastomer layer comprises a space for receiving a tear gas pellet and means for sealing said tear gas pellet in said space.

19. The apparatus of claim 1, wherein said elastomer layer comprises embedded fibers.

20. The apparatus of claim 19, wherein said fibers comprise glass fibers.

21. The apparatus of claim 19, wherein said fibers comprise carbon fibers.

22. The apparatus of claim 1, wherein the smoke composition particles have a particle size which is adapted to generate smoke via a sublimation process when ignited.

23. The apparatus of claim 1, wherein the elastomer is stable above a temperature at which the smoke composition particles burn.

24. A security alarm pack for insertion in a pack of currency, the security alarm pack comprising a flexible elastomer layer comprising particles that are disbursed throughout said elastomer layer and that generate smoke when ignited.

25. The security alarm pack of claim 24, wherein the particles are adapted to generate the smoke via a sublimation process.

26. The security alarm pack of claim 24 further comprising a power source, an electric ignition source connected to the power source and in contact with the elastomer layer for igniting the particles to generate smoke, and a flexible electrical circuit connected to the power source and the electric ignition source for activating the ignition source.

27. The security alarm pack of claim 26 further comprising an antenna connected to the electrical circuit for receiving an activation signal.

28. The security alarm pack of claim 24, wherein the security alarm pack has a flexibility that provides for a first pack of currency comprising the security alarm pack to present a feel similar to that of a second pack of currency that does not comprise the security alarm pack.

* * * * *